US005355551A

United States Patent [19]

Schechter et al.

[11] Patent Number: 5,355,551

[45] Date of Patent: Oct. 18, 1994

[54] SCENT-RELEASING CURTAIN RINGS

[76] Inventors: Daniel R. Schechter; Susan Murphy, both of 105 Cooper Ct., Port Jefferson, N.Y. 11777

[21] Appl. No.: 53,916

[22] Filed: Apr. 27, 1993

[51] Int. Cl.[5] ..... A44B 13/00; A44B 21/00; E05D 15/00

[52] U.S. Cl. ..... 16/87.2; 239/34; 428/905; 24/716

[58] Field of Search ..... 24/3 K, 343, 716; 16/87.2; 428/905; 239/34, 52; 223/86

[56] References Cited

U.S. PATENT DOCUMENTS 2,585,500 2/1952 Roy ..... 16/87.2
2,946,511 7/1960 Bartus ..... 239/34
4,419,396 12/1983 Sugimoto ..... 428/905
5,018,974 5/1991 Carnahan et al. ..... 428/905
5,039,243 8/1991 O'Brien ..... 428/905
5,122,401 6/1992 Finkelstein ..... 428/905

*Primary Examiner*—Lowell A. Larson
*Assistant Examiner*—Donald M. Gurley
*Attorney, Agent, or Firm*—Darby & Darby

[57] ABSTRACT

A curtain ring having a fragrance-releasing material mounted on its inner diameter. The material is selected so that the fragrance will only be released when the consumer opens or closes the curtain, that is, only when the material is rubbed against the curtain rod.

4 Claims, 1 Drawing Sheet

SCENT-RELEASING CURTAIN RINGS

FIELD OF THE INVENTION

This invention relates generally to devices for supporting sheet materials. More specifically, this device relates to curtain rings that emit fragrance when the curtain is moved.

BACKGROUND OF THE INVENTION

For as long as there has been a sense of smell, man has attempted to mask the less desirable odors of society. This is nowhere more evident than in the room deodorizer industry. There are solids, liquids, sprays and even electrically powered deodorizers, all with their own individual problems.

Except for sprays, all of the other types of deodorizers suffer serious drawbacks because they work automatically, regardless of the immediate need to mask odors or even the presence of people in the room. The solids and liquids include a fragrant chemical that slowly dissolves and releases the fragrance into the room. Unfortunately, they release the chemical all the time. If an occupant leaves the premises for an extended period of time, for example, by going on vacation, the solids and liquids continue to release their chemicals, saturating the air with the fragrance and causing the furniture and other fabrics in the premises to become impregnated by the smell. Further, once the occupant returns, he or she will not only be subjected to a much higher level of fragrance than normally desired, but will also be breathing in an unhealthy amount of the fragrance chemicals.

These solids and liquids also cause tremedous environmental waste. Not only are the chemicals constantly pumped out, but they usually come in disposable containers that become part of the waste stream, which is an ever-increasing concern.

Electric-powered deodorizers cause even greater harm in that they not only dispense an excess of fragrance, but waste valuable energy doing it, in addition to the pollution resulting from the creation of that energy.

Sprays overcome some of these problems, in that they are only used when desired by the occupant, thus avoiding any serious waste. However, sprays require that the occupant keep the bottle or can within easy reach. Also, the can or bottle from which the spray is dispensed is also usually thrown away into the waste stream. The sprays can also coat furniture with the chemicals or even coat the user.

In view of the deficiencies of the known room deodorizers, it is an object of the present invention to provide a deodorizer that will automatically dispense fragrance into a room, but only when the occupant is present.

It is a further object of the invention to provide a deodorizer that does not use any electricity or other commercial energy source.

It is another object of the invention that the deodorizer be replaceable.

It is yet another object of the invention that the deodorizer be easily and cost-effectively manufactured.

In accordance with the objects of the invention, a curtain ring is provided with a fragrance-releasing material mounted on its inner diameter. The material is selected so that the fragrance will only be released when the consumer opens or closes the curtain, that is, only when the material is rubbed against the curtain rod.

BRIEF DESCRIPTION OF THE DRAWINGS

The above and other objects and advantages will become apparent to those skilled in the art upon reading the following detailed description of the preferred embodiment, in conjunction with a review of the appended drawings, in which.

DETAILED DESCRIPTION OF THE PREFERRED EMBODIMENTS

Figure 1:
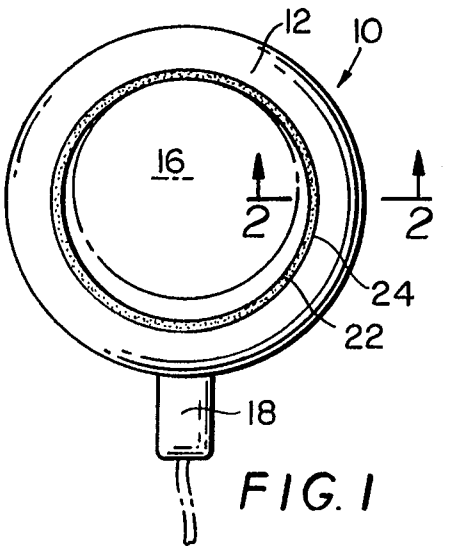
FIG. 1 is a side view of a curtain ring according to the present invention.

Referring to FIG. 1 a shower curtain ring 10 according to a preferred embodiment is shown. The ring 10 is comprised of a ring member 12 that may be an a complete or incomplete circle (12', FIG. 5), or may be any other desired shape. For example, the ring member 12 may be a complete circle with a releasable catch 14 (FIG. 3) to permit mounting onto a curtain rod 16.

A hook member 18 for retaining the curtain preferably extends from the ring member 12. In certain preferred embodiments, such as with a complete circle ring member 12, the hook member 18 may be unnecessary, since the curtain 20 can be mounted on and retained by the ring member 12" itself (see FIG. 3).

Figure 2:
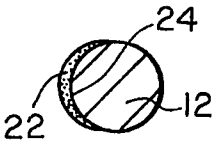
FIG. 2 is a cross section taken along the line 2—2 of FIG. 1.

Regardless of the shape of the ring member 12, a fragrance-releasing material 22 is mounted on the interior circumference or surface 24 of the ring member 12. As seen in FIGS. 1 and 2, this fragrance-releaser 22 preferably extends radially inward from the cross-section of the ring member 12.

The fragrance-releaser 22 can be comprised of any material that releases fragrance into the surrounding atmosphere when rubbed against an appropriate surface. For example, certain waxes that have been impregnated with fragrance are known to release the fragrance into the atmosphere upon frictional rubbing of the wax (such as those used in flavored dental floss). Other materials, such as microspheres containing fragrance chemicals, or materials used in "scratch-and-sniff" products, will work similarly.

Figure 4:
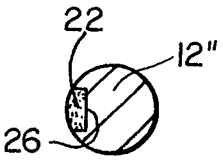
FIG. 4 is a cross section taken along the line 4—4 of FIG. 3.
Figure 3:
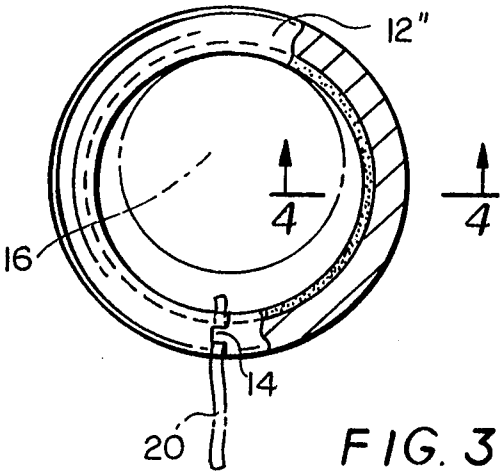
FIG. 3 is a side view of a curtain ring according to an alternate embodiment of the invention.

An alternative to the embodiment of FIGS. 1 and 2 is shown in FIGS. 3 and 4, in which the fragrance-releaser 22 is slightly embedded within a channel 26 on the interior circumference of the ring member 12. Preferably, even when within the channel 26, a significant portion will extend radially inward from the edges of the channel 26 to ensure contact between the fragrance-releaser 22 and the rod 16 when the ring is installed on a curtain rod 16. If the fragrance-releaser 22 is formed of a sufficiently rigid material, the fragrance-releaser 22 can be provided in replaceable units that are easily inserted into the channel 26 when necessary. Similarly, the fragrance-releaser 22 can be provided in a form that can be squirted or poured into the channel 26, so long as its eventual consistency allows it to remain in the channel 26 once applied.

Figure 5:
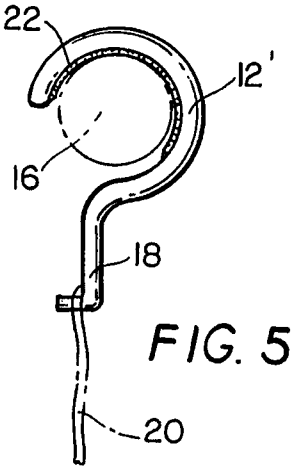
FIG. 5 is a perspective view of a curtain ring according to the invention mounted on a rod.
Figure 6:
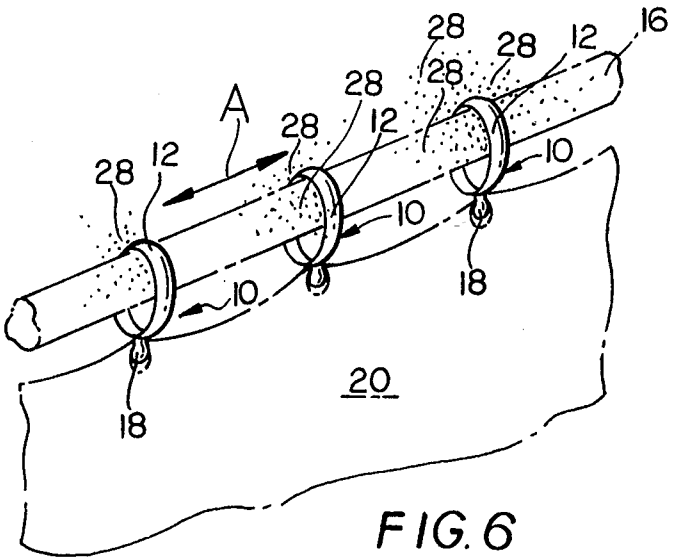
FIG. 6 is a perspective view of several curtain rings supporting a curtain according to the invention suspending a curtain.

As can be seen from FIG. 5, once the ring member 12' is mounted onto the curtain rod 16, the fragrance-releaser 22 will rest directly on the rod 16. In the preferred embodiment, the hook member 18 hangs below the rod 16 ! and penetrates a hole within the curtain 20 or a loop connected to the curtain. Of course, as is shown in FIG. 6, multiple rings 10 according to the invention may be attached to a single curtain 20, although it is only necessary for at least one ring 10 to be according to the present embodiments.

In operation, the curtain 20 will normally be stationary in a particular position until opened or closed by the consumer. While stationary, it is preferred that no fragrance is released from the fragrance-releaser 22, as this would rapidly diminish the life-span of a particular fragrance-releaser 22 and waste the fragrance as described above. Once the consumer either opens or closes the curtain (as shown by arrow A, FIG. 6), the fragrance-releaser 22 will rub on the curtain rod 22 and cause fragrance particles 28 to be released into the atmosphere. For example, with a shower curtain, the fragrance 28 will be released into the bathroom air only when the consumer moves the curtain 20 (e.g. to take a bath or shower), thereby maximizing the effectiveness of the fragrance-releaser 22 and minimizing waste and pollution. With window curtains, fragrance will only be released when the consumer opens or closes them, again preventing the constant wasteful fragrance release of known air fresheners.

If desired, the fragrance-releaser 22 could also be manufactured to release minute amounts of fragrance when not in use. These amounts would preferably be much less than with conventional solids and liquids, since a significantly larger amount would be release upon moving the curtain 20.

It is contemplated that the entire ring member 12 could be formed of a fragrance-releasing material, although it would be necessary to ensure that the entire ring member does not wear through and fall off of the rod.

While the embodiments shown and described are fully capable of achieving the objects of the invention, it is to be understood that these embodiments are shown and described solely for the purpose of illustration and not for the purpose of limitation.

What is claimed is:

1. A curtain ring for mounting a curtain rod and for suspending a curtain, comprising:

a ring member suspendable on said rod, said ring member having a means for releasing fragrance integral therewith, said means releasing a fragrance into the atmosphere in response to movement of said means along said rod.

2. A curtain ring for mounting a curtain to a curtain rod, comprising:

a ring member suspended on said rod, said ring member having an interior surface abutting said rod;

means for attaching said ring member to said curtain such that said curtain is suspended from said rod; and means for releasing fragrance, said means for releasing mounted on said interior surface such that upon moving said ring member along said rod, said means for releasing will frictionally engage said rod to thereby release fragrance.

3. A curtain ring as in claim 2, wherein said means for releasing fragrance is detachable from said ring member and interchangeable.

4. A curtain ring as in claim 2, wherein said ring member has a channel along said interior surface for receiving said means for releasing fragrance.

* * * * *